United States Patent [19]

Harter

[11] Patent Number: 4,550,640

[45] Date of Patent: Nov. 5, 1985

[54] MISSILE CANISTER RESTRAINT DEVICE

[75] Inventor: Robert R. Harter, Apopka, Fla.

[73] Assignee: Werkzeugmaschinenfabrik Oerlikon-Buehrle AG, Zurich, Switzerland

[21] Appl. No.: 532,743

[22] Filed: Sep. 16, 1983

[51] Int. Cl.[4] ..... F41F 3/04

[52] U.S. Cl. ..... 89/1.806; 89/1.816

[58] Field of Search ..... 89/1.806, 1.807, 1.816, 89/1.817, 1.812, 1.8

[56] References Cited

U.S. PATENT DOCUMENTS

| | | | |
|---|---|---|---|
| 2,831,400 | 4/1958 | Hösli | 89/1.806 |
| 3,076,385 | 2/1963 | Bornhöft | 89/1.806 |
| 3,296,929 | 1/1967 | Jacobson | 89/1.806 |
| 3,754,726 | 8/1973 | Rusbach | 89/1.816 X |
| 3,811,360 | 5/1974 | Ricks | 89/1.807 |
| 4,132,150 | 1/1979 | Conn | 89/1.806 |
| 4,304,170 | 12/1981 | King | 89/1.807 |
| 4,336,740 | 6/1982 | Leigh et al. | 89/1.806 |

FOREIGN PATENT DOCUMENTS

| | | | |
|---|---|---|---|
| 1428642 | 11/1968 | Fed. Rep. of Germany | 89/1.806 |
| 1265331 | 5/1961 | France | 89/1.806 |
| 1340562 | 12/1962 | France | 89/1.806 |
| 388139 | 6/1975 | Switzerland | 89/1.806 |
| 1182275 | 2/1970 | United Kingdom | 89/1.806 |

*Primary Examiner*—David H. Brown

*Attorney, Agent, or Firm*—Julian C. Renfro; William J. Iseman; Gay Chin

[57] ABSTRACT

A no-load missile restraint arrangement for releasing a rocket propelled missile promptly after ignition of its rocket motor, and the expulsion of a nozzle seal from its rocket motor nozzle. An anchor device extends from the aft end of the missile, which is engaged by the nose portion of a pivotable latch member. The latch member has two operative positions, with the nose portion engaging the anchor device until the seal is driven rearwardly at the time of ignition of the rocket motor. An elongate device operatively associated with the latch member is struck by the rapidly moving seal, bringing about the releasing of the latch member such that it can pivot to an anchor-releasing position. In this way the missile is released prior to any substantial buildup of thrust in the rocket motor.

6 Claims, 7 Drawing Figures

MISSILE CANISTER RESTRAINT DEVICE

BACKGROUND OF THE INVENTION

It is well known in the art to utilize a technique wherein missiles shortly after their manufacture are placed in shipping containers, such that damage to the missiles will not occur during the interval between their manufacture, and the time they are deployed for firing.

Thereafter, it was realized that the shipping container could be designed in such a manner that the missile could subsequently be fired directly from the container, rather than having to be removed therefrom and placed in a launch device. The Banta et al U.S. Pat. No. 3,988,961 entitled "Integrated Rocket Shipping Container and Launcher" is typical of a rocket container-launcher that, on the one hand, is capable of withstanding normal shipping forces, and on the other hand, may serve as a launch device from which the missile can later be fired.

It is also known in the art to utilize a retaining mechanism in a launch tube such that the missile will not be dislodged from the desired location in the tube until the exact moment it is to be fired. Typical restraint devices utilize bolts, or the like, that hold the missile in the proper location in the canister or launch tube until the motor is ignited, and the forces created thereby build to such a point as to cause a failure, such as by shearing, of the restraint bolt or bolts. Unfortunately, by the time the propulsion forces of the rocket have risen to such a point that bolt shearing is brought about, the buildup of forces is so great as to cause a substantial shock to the missile, such that certain components therein are prone to fail.

Others have endeavored to solve this problem by arranging the blast issuing from the ignited rocket to bring about rotation of a latching arm that will bring about release of the rocket. The Wissner U.S. Pat. No. 3,659,493 teaches such an arrangement. However, release of the restraints on the missile in such an arrangement unfortunately do not occur with sufficient rapidity as to obviate damage to certain vital components contained in the missile.

It was in an effort to overcome these disadvantages that the present invention was developed.

SUMMARY OF THE INVENTION

In accordance with this invention I have provided a combined canister and launch tube such that the missile may be transported in such tube and at the proper time thereafter, launched from the tube. However, instead of utilizing a shear bolt type arrangement wherein substantial forces must be developed before missile release, I utilize a highly reliable arrangement that functions to free the missile almost instantaneously upon the inception of the flow of hot gases from the nozzle of the rocket engine.

In most solid propellant rocket motors, an environmental seal or plug is placed in the rocket nozzle shortly after manufacture, and I have designed a device making use of the fact that such a seal or plug is expelled rearwardly from the nozzle immediately after ignition of the rocket motor.

I mount an anchor means, which may take the form of an eye bolt or the like, at or near the aft end of the missile. Mounted in the canister adjacent the aft end of the missile is disposed a base member, and mounted upon this base member or base bracket is a pivotable latch member having two positions. The pivotable member has means thereon for engaging the anchor means, and when in its first position, its anchor-engaging means firmly restrains the missile against forward movement. An elongate trigger member is attached to the base member and to the pivotable member, and a portion of such trigger member or trigger means extends into a position adjacent the nozzle seal. Upon ignition of the rocket motor, the seal is blown rearwardly with great force, striking the trigger member, which in turn permits the pivotable member to move to its second position, and release the anchor means. Advantageously, this release of the missile occurs well before any substantial buildup of thrust in the rocket motor, thus obviating any shock damage to sensitive components in the missile. Therefore, I refer to my device as a no-load missile restraint arrangement.

The trigger member may take the form of an elongate member that is physically bent by the force of the rapidly moving seal, and the bending of the elongate member releases the pivotable latch member from its first position, so that it in turn can release the missile.

It is therefore to be seen that I have provided a highly reliable yet inexpensive means for holding a missile in its launcher until rocket ignition has taken place, with release of the missile thereafter taking place with certainty yet without shock to the relatively delicate components contained in the interior of the missile.

It is a principal object of my invention to provide a highly dependable missile restraint mechanism in a missile launcher that will reliably release the missile almost instantaneously after motor ignition.

It is another object of my invention to provide a low cost missile restraint device that will reliably release the missile before any great buildup of thrust forces subsequent to motor ignition.

DETAILED DESCRIPTION

Figure 1:
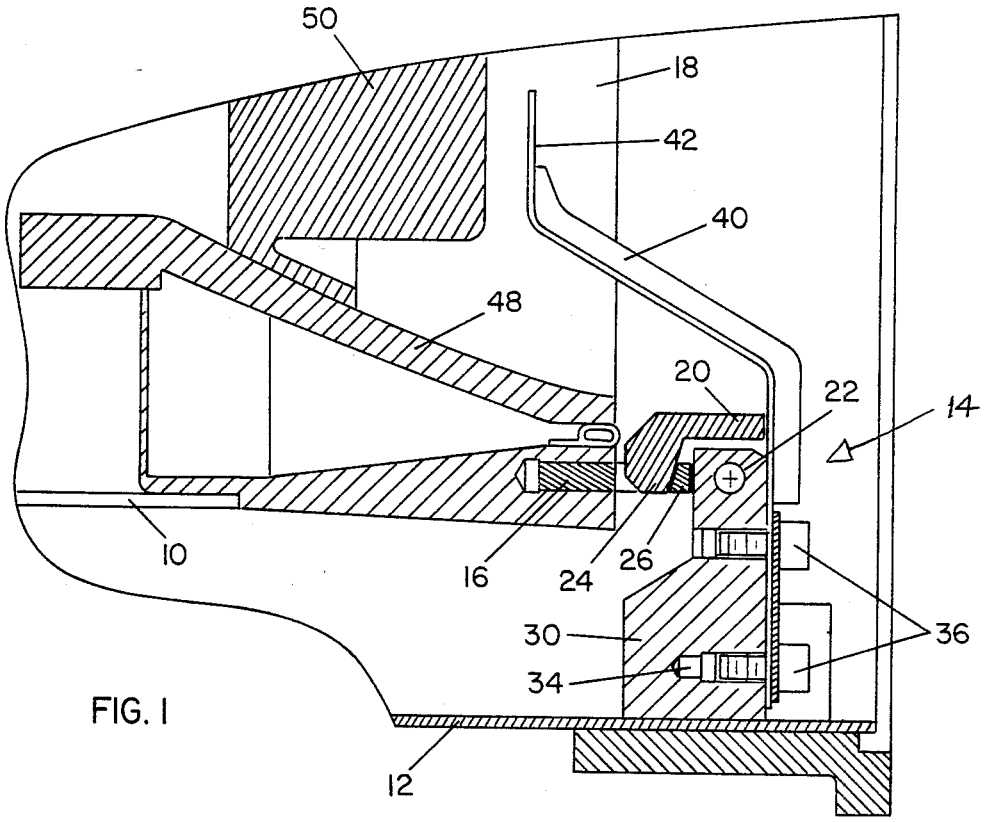
FIG. 1 is a side elevational view of a primary embodiment of my invention, with certain components being sectionalized to illustrate how the missile is restrained prior to engine ignition.

In FIG. 1 I have shown a fragmentary portion of the aft part of a missile 10, disposed in a canister 12, and restrained from movement out of the canister by means of my novel restraint device 14. The missile is normally held in a fixed position in canister 12 by a suitable anchor means, such as an eye bolt 16 that is bolted to the base portion 18 of missile 10.

Figure 5:
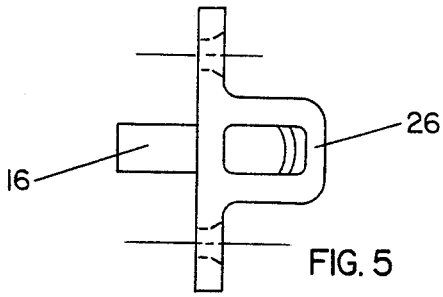
FIG. 5 is a showing of the eye bolt I prefer to use.

Pivotable latch member 20 is an important portion of the restraint device 14, and the latch member is pivotally mounted on a pin 22, and is equipped with an angled nose portion 24 that is arranged to engage the "eye" portion 26 of eye bolt 16. The eye bolt is best seen in FIG. 5.

Figure 2:
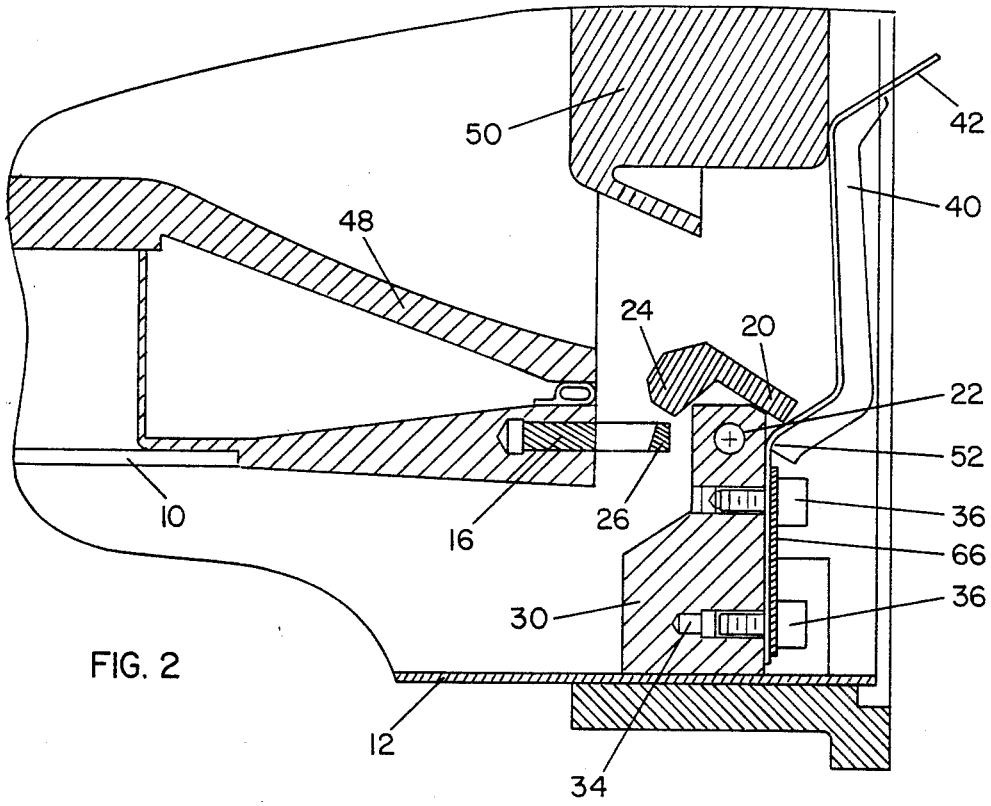
FIG. 2 is a side elevational view much like FIG. 1, but showing the pivoting of the latch member almost instantaneously after expulsion of the nozzle seal due to motor ignition, thus obviating any great buildup of forces prior to release of the missile.
Figure 3A:
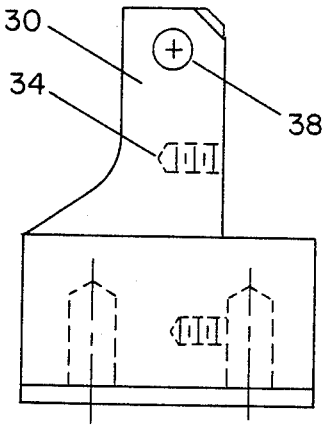
FIGS. 3*a* and 3*b* illustrate the base member viewed from two different angles, this bracket forming the support for the pivotable latch member.
Figure 3B:
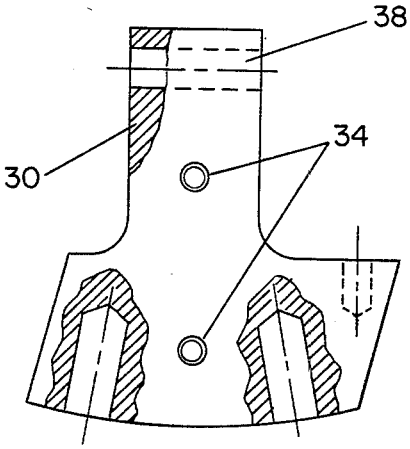

At the time the latch member 20 is actuated to cause a release of the anchor means, the latch member pivots about pin 22, such that the nose portion 24 moves out of engagement with the eye part 26 of the bolt 16. This condition is illustrated in FIG. 2.

Base member 30 is firmly mounted, typically in the inner rear portion of the canister 12, and it serves to support the pivotable latch member 20 as well as certain other components shortly to be described. As illustrated in FIGS. *3a* & *3b*, the bottom part of base member 30 is tapped so as to receive bolts extending up through the sidewall of the canister. The bottom of base member 30 possesses curvature in one dimension, as illustrated in FIG. *3b*, so as to fit snugly against the inner sidewall of canister 12.

Figure 4A:
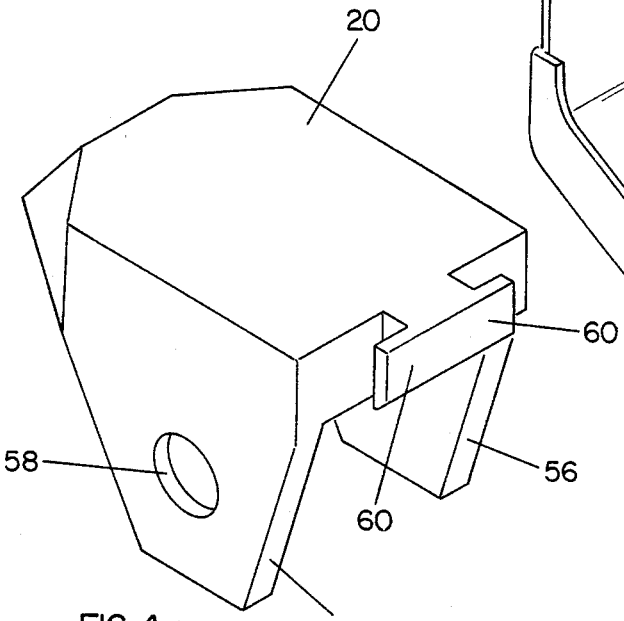
FIGS. 4*a* and 4*b* are perspective views, illustrating in exploded relation and to a larger scale, the pivotable latch member and the elongate trigger member.
Figure 4B:
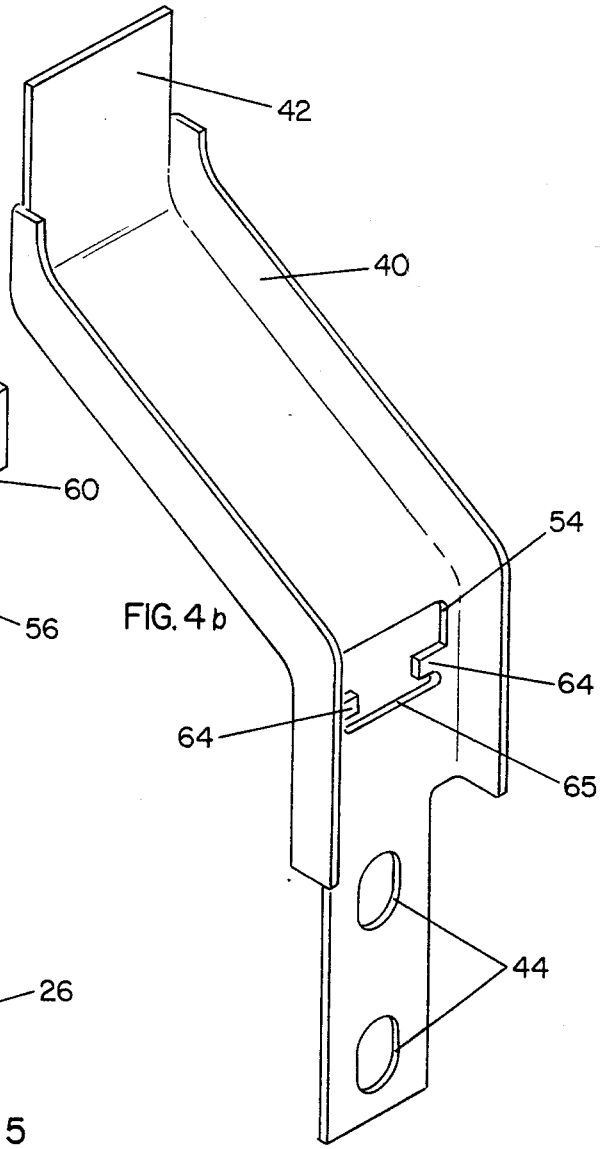

The rear edge of the base member 30 preferably has two tapped holes 34 arranged to receive bolts 36, these tapped holes being indicated in FIGS. *3a* & *3b*. Such bolts serve to hold an elongate trigger member 40 in the erect position illustrated in FIG. 1, with the "target" or impact portion 42 of the trigger member disposed close to the centerline of the nozzle 48. The trigger member or trigger means 40 has elongate mounting holes 44 in its lower portion, through which the bolts 36 extend when the trigger member is to be secured to the base member 30; see FIG. 4. Significantly, the holes 44 are elongate in the direction of the long dimension of the trigger member 40, to permit a limited amount of sliding motion of the latter member relative to the base member 30 during the installation of the trigger member. The reason for this feature will be more apparent as the description proceeds.

When the propulsion motor (not shown) of the missile 10 is fired, it causes immediate expulsion of the circular nozzle seal or plug 50 from the nozzle 48, with the plug 50 flying rearwardly at great speed, which is to the right as viewed in FIG. 1. The plug 50 contacts the target portion 42 of the trigger member 40 with sufficient force as to cause the trigger member 40 to bend at location 52, in the manner illustrated in FIG. 2. Stiffner 66 helps assure the trigger member 40 bending at the desired location.

It is to be noted that a lower part of the trigger member is in an interlocking relationship with the rear portion of the pivotable member 20. This relationship is made clear in FIG. 4, which depicts the latch member 20 and the trigger member 40 in exploded relation and to a larger scale. Importantly, in FIG. 4 a hole 54 in the trigger member 40 is revealed, in which hole are disposed a pair of tabs 64, that are arranged to engage ears 60 on the upper rear part of the pivotable latch member 20.

The pivotable latch member 20 has spaced legs or mounting portions 56 on its underside, through each of which extends a hole 58. Only one of such holes is visible in FIG. 4. The pivotable latch member 20 is normally supported on the upper portion of base member 30, in the manner shown in FIG. 1, with the pin 22 being pushed through the aligned holes 58 when they are in alignment with the hole 38 in the top of the bracket or base member 30. A substantial part of the underside of pivotable latch member 20 is hollowed out, so that it can pivot about the bracket 30 for a substantial number of degrees without difficulty or restraint.

In the use of my invention, it is to be presumed that the pin 22 is in a position so as to mount the pivotable latch member on the upper portion of the base member 30, with the ears 60 of the latch being on the rear side of the latch, closely adjacent the intended location for the trigger member 40.

At the time the trigger member is to be affixed to the base member 30, the lower part of the trigger member is brought closely adjacent the rear part of the latch member 20, such that the ears 60 of the latch extend through the notch or hole 54 in the lower part of the trigger member. At this point the elongate trigger member 40 is slid along the direction of its long dimension, so as to cause the tabs 64 located in the notch 54 to go behind the ears 60 on the latch member 20. Now the bolts 36 may be installed through the elongate mounting holes 44 and into the tapped holes 34 in the base member 30.

At this point the purpose for making the holes 44 in the lower part of the trigger member elongate should becomes obvious, for by being elongate, it is possible for the elongate trigger member 40 to be adjusted with respect to the base member 30 so as to remove undesirable slack, or in other words to provide line contact between members 24, 26 and 30. More particularly, the slotted holes 44 enable the trigger member 40 to be raised until surface 65 at the bottom of the opening 54 contacts the underside of the ear member 60, thus to pivot member 20 until the angled surface of nose 24 fits tightly against the rear part of the eye of the eye bolt, and clamps it against the front side of member 30. After the desired degree of clamping has been achieved, the bolts 36 are firmly tightened.

As should now be apparent, upon the engine being ignited, the plug 50 will be propelled rearwardly with great force, and cause the elongate trigger member 40 to be moved into the bent over position shown in FIG. 2, which causes the tabs 64 to bend so as to release the ears 60 of the pivotable latch member 20. Upon this occurrence, the latch member can pivot into the position shown in FIG. 2, which brings about the nose portion 24 moving out of contact with the eye bolt 16, or another selected form of anchor member. The pivoting of the member 20 is assured by constructing the nose portion 24 to have a non-vertical angle, and I prefer for the portion of the nose 24 that contacts the eye 26 of the eye bolt 16 to be at an angle of approximately 15° to the vertical, as is to be seen in FIG. 1. Likewise, the interior surface of the eye portion of bolt 16 contacted by the nose 24 is preferably disposed at the same or a similar angle.

As to constructional materials, in a preferred missile application, all details are made of a stainless steel class, but I am not to be limited to such materials, for in other applications, other materials may be acceptable.

Upon the pivoting of the latch member 20, the missile is released such that it can fly out of the canister without great shock, which flight is to the left as viewed in FIG. 2.

I claim:

1. A springless, no-load missile restraint arrangement involving substantially no compromise of the aerodynamic configuration of a missile, said restraint arrangement releasing a rocket propelled missile from its canister promptly after ignition of its rocket motor, and the expulsion of a nozzle seal from its rocket motor nozzle, said restraint arrangement comprising an elongate anchor means of small diameter extending from the aft end of the missile, a base member mounted on the interior of said canister adjacent the aft end of the missile and supporting a pivotable member, said pivotable member having an anchor-engaging position, and an anchor-releasing position, trigger means operatively associated with said pivotable member, and extending into a position adjacent the nozzle seal, said trigger means, when struck by the seal shortly after motor ignition, deforming to permit a pivoting movement of said pivotable member into its anchor-releasing position, such that the missile can sever any restraints to the canister before substantial buildup of thrust in the rocket motor.

2. A springless, no-load missile restraint arrangement involving substantially no compromise of the aerodynamic configuration of a missile, said restraint arrangement releasing a rocket propelled missile from its canister promptly after ignition of its rocket motor, and the expulsion of a nozzle seal from its rocket motor nozzle, said restraint arrangement comprising an elongate anchor means of small diameter extending from the aft end of the missile, a base member mounted on the interior of the canister adjacent the aft end of the missile and supporting a pivotable member, said pivotable member having an anchor-engaging position, and an anchor-releasing position, an elongate trigger member attached to said base member and to said pivotable member, and extending into a position adjacent the nozzle seal, said trigger member, when struck by the seal shortly after motor ignition, deforming to permit a movement of said pivotable member into its anchor-releasing position, such that the missile can sever any restraints to the canister before substantial buildup of thrust in the rocket motor.

3. A springless, no-load missile restraint arrangement involving substantially no compromise of the aerodynamic configuration of the missile, for releasing a rocket propelled missile from its canister promptly after ignition of its rocket motor, and the expulsion of a nozzle seal from its rocket motor nozzle, said release arrangement comprising an elongate anchor means of small diameter secured to the aft end of the missile, to which releasable restraint means are attached, said restraint means comprising a base member mounted in an aft portion of the canister, adjacent the aft end of the missile, a pivotable member supported upon said base member, and having first and second positions, said pivotable member having a nose portion arranged, when the pivotable member is in its first position, to engage said elongate anchor member, said pivotable member moving to its second position, to bring about the release of the anchor member, upon expulsion of the seal from the nozzle of the rocket motor, and the seal striking a deformable component operatively associated with said pivotable member.

4. The springless, non-load missile restraint arrangement as recited in claim 3 in which an elongate member is supported by said base member at a location adjacent said pivotable member, with said elongate member and said pivotable member being interconnected, said elongate member extending approximately to the centerline of the motor nozzle, so as to be in the path of the seal at the time it is expelled from the nozzle by the initial buildup of pressure in the rocket motor, said elongate member, upon being struck by the seal, deforming to release the pivotable member, so that it can pivot into its second position, thus to release the anchor member before any substantial buildup of thrust in the rocket motor.

5. The springless missile restraint arrangement as recited in claim 4 wherein said anchor member is an eyebolt.

6. The springless, no-load missile restraint arrangement as recited in claim 4 wherein said elongate member is vertically adjustable with respect to said pivotable member, so as to enable at the time of installation, the removal of undesirable slack between said elongate anchor means and said nose portion.

* * * * *